US006412234B1

(12) United States Patent
Leoni

(10) Patent No.: US 6,412,234 B1
(45) Date of Patent: Jul. 2, 2002

(54) MODULAR UPRIGHT FOR BUILDING STRUCTURES AND ASSOCIATED SLIDING SAFETY GRILLE

(75) Inventor: Roberto Leoni, Cattolica (IT)

(73) Assignee: Mito S.r.l. (IT)

( * ) Notice: Subject to any disclaimer, the term of this patent is extended or adjusted under 35 U.S.C. 154(b) by 0 days.

(21) Appl. No.: 09/507,820

(22) Filed: Feb. 22, 2000

(30) Foreign Application Priority Data

Feb. 19, 1999 (IT) ..... RN99A0005

(51) Int. Cl.[7] ..... E04H 3/08

(52) U.S. Cl. ..... 52/106; 52/507; 49/55; 49/56; 160/159; 160/206

(58) Field of Search ..... 52/106, 660, 664, 52/665, 581, 695, 656.8, 693, 471, 507, 720.1; 160/210, 136, 216, 255, 10, 137, 159, 160, 218, 222, 223; 49/50, 55, 56, 124, 221, 323, 463, 141, 395, 381

(56) References Cited

U.S. PATENT DOCUMENTS 1,718,649 A * 6/1929 Jackson, Jr.
1,721,998 A * 7/1929 Jackson, Jr.
1,877,829 A * 9/1932 Erlinder
2,262,800 A * 11/1941 Farmer
4,006,768 A * 2/1977 Horgan, Jr. ..... 160/136
4,677,791 A * 7/1987 Larson et al. ..... 49/463
5,373,887 A * 12/1994 Glover ..... 160/206
5,437,134 A * 8/1995 Donnelly ..... 52/507
5,535,803 A * 7/1996 Pretorius ..... 160/136
6,112,460 A * 9/2000 Wagnitz ..... 40/55

FOREIGN PATENT DOCUMENTS

DE 3239415 5/1984

* cited by examiner

*Primary Examiner*—Carl D. Friedman
*Assistant Examiner*—Yvonne M. Horton
(74) *Attorney, Agent, or Firm*—Orum & Roth

(57) ABSTRACT

The present invention relates to a modular upright for building structures and a sliding safety grille which can be obtained by assembling these uprights. In a preferred embodiment, the modular upright (10) comprises a pair of anti-cutting reinforcing elements (1) which are lined by U-shaped modular elements (3) alternating with joining elements (2) and fastened together by at least one anti-pulling element (6) sliding vertically between two joining elements (2), in the space between the surface of the reinforcing elements (1) and the U-shaped modular elements (3).

12 Claims, 2 Drawing Sheets

MODULAR UPRIGHT FOR BUILDING STRUCTURES AND ASSOCIATED SLIDING SAFETY GRILLE

BACKGROUND OF THE INVENTION

The present invention relates to modular uprights and the sliding safety grille formed by them.

Numerous designs of sliding safety grilles are very common nowadays, said grilles being designed to pass from an operating position, where they protect doors and windows, to a rest position, where they are folded up and adjacent to the edge of their frame or the opening, thus drastically reducing their dimensions.

As they have become more widespread, the range of dimensions of the openings which must be protected by these grilles has correspondingly increased: however, because of the level of safety which the grilles must ensure, hitherto the possibility of disassembling the uprights which form them has been overlooked.

This situation has therefore obliged manufacturers to provide a large number of constructional designs, with the disadvantage of increasing substantially the storage space which is needed to cope with client's requests or, alternatively, resulting in delays in supplying of most of the parts required.

Moreover, this has meant that the sliding grilles are supplied to the user already assembled and ready for installation and that, therefore, transporting them is difficult owing to the large dimensions which they have.

Finally, if there are errors in the manufacture of the iron gratings, the structure of the latter is such that adjustments are not possible and this may give rise to huge numbers of rejects in terms of material.

BRIEF SUMMARY OF THE INVENTION

The object of the present invention is that of eliminating the drawbacks mentioned above. The invention, as characterized by the claims, solves the problem of providing solid sliding safety grilles using modular uprights.

One of the advantages obtained by the present invention consists essentially in the fact that a modular element of a single type may be used and can be associated with an arbitrary number of other identical modules: this in fact results in the possibility of managing a single type of warehouse and of providing grilles of practically any height.

Moreover, owing to its modular nature, the grille may also be assembled by the retailer or even by the user, reducing the transportation costs and hence the price of the grille. Finally, it is possible to eliminate errors in measurement, even when the grille has been completed, by simply replacing one or both the end components of the uprights.

BRIEF DESCRIPTION OF THE DRAWINGS

The invention is explained in greater detail below with the aid of the drawings which show a purely exemplary and non-limiting example of embodiment thereof, in which.

DESCRIPTION OF THE PREFERRED EMBODIMENTS

As can be seen from the Figures, the invention relates to a modular upright for the formation of sliding safety grilles and the grilles which are obtained therefrom.

Figure 1:
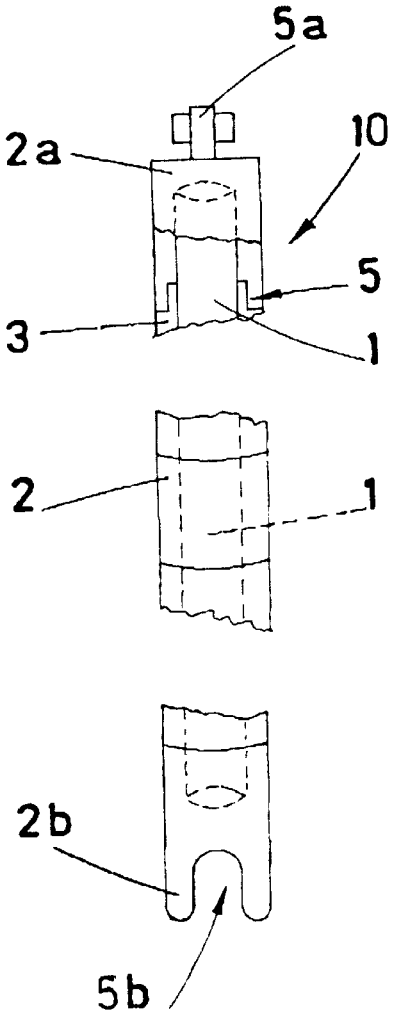
FIG. 1 shows a first embodiment of the invention, with some parts removed so that others may be seen more clearly.

In one embodiment thereof, shown in FIG. 1, the modular upright (10) comprises an anti-cutting reinforcing element (1), for example an iron rod, which is externally lined with a multiplicity of modular elements (3), which are at least two in number and shaped so that each covers a portion thereof and alternate in the vertical direction with joining elements (2) provided both with holes (4) through which the anti-cutting reinforcing elements (1) pass and with means (5) for fastening to the modular elements (3). The said means, in the example of embodiment shown, consist of lugs (5) which are shaped so as to match the internal profile of the modular elements (3) and generally consist of aluminium extruded parts.

The joining elements (2*a*,2*b*) located at the ends of each modular upright (10) are also provided with additional means (5*a*,5*b*) for fastening to a fixed frame (11) of the sliding grille (20).

In the example shown, these additional fastening means (5*a*,5*b*) are formed for example—without excluding in any way any equivalent solution—by a wheel (5*a*) which is designed to travel in a rail (11*a*) of the fixed frame (11) of the grille (20) and a recess (5*b*) matching a shoulder (11*b*) projecting therefrom.

Figure 2:
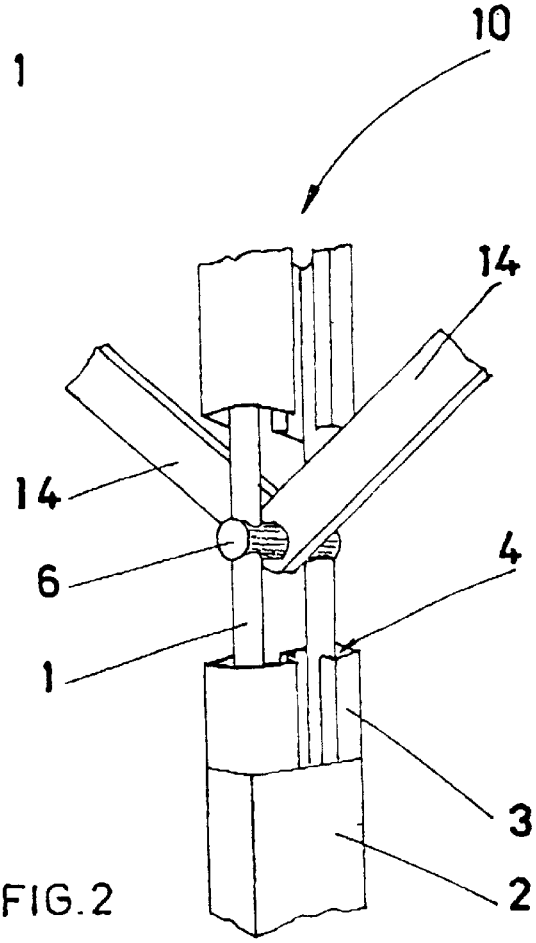
FIG. 2 shows a perspective view of a second embodiment of the invention.

The successive figures show a second embodiment of the invention and the grille (20) which is obtained therefrom by assembling the modular uprights (10) with each other. FIG. 2 shows in fact a modular upright (10) comprising a pair of adjacent anti-cutting reinforcing elements (1), each of which is lined with U-shaped modular elements (3) which are arranged so that the respective cavities are facing and alternate with joining elements (2) of the type described. In this preferred embodiment, the anti-cutting reinforcing elements (1) of the said modular upright (10) are fastened together by at least one anti-pulling element (6) sliding vertically between two joining elements (2) in the space between the said reinforcing elements (1) and the modular elements (3) which cover them. Although it is advisable to repeat a connection of this type between each pair of joining elements (2), it is obvious that, in particular in the case of very high uprights (10), this is not strictly indispensable: in any case using a small number of anti-pulling elements (6) does not depart from the protection of the present patent nor does it limit the solidity of the upright (10).

Figure 3:
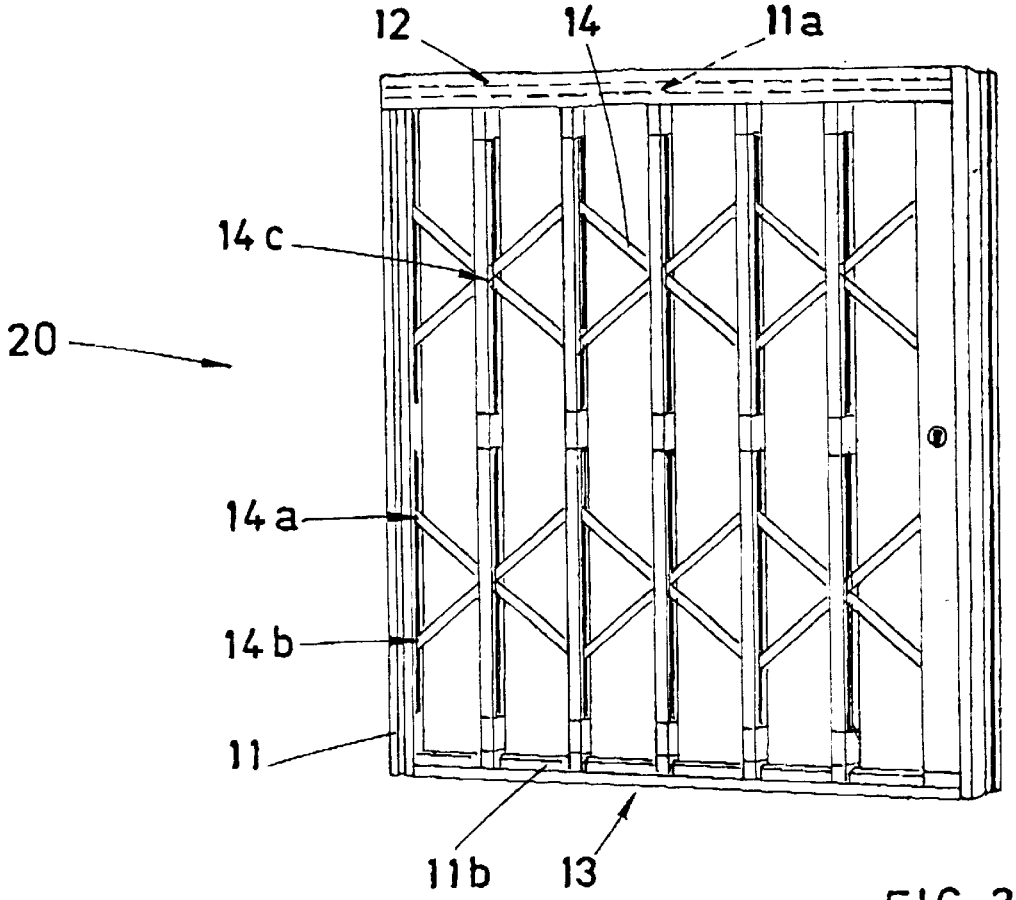
FIG. 3 shows the invention assembled so as to form a complete grille.
Figure 4:
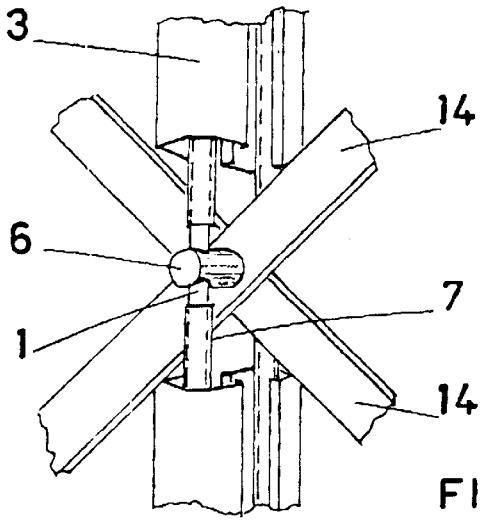
FIG. 4 shows some constructional details of the invention.

FIG. 3 also shows a sliding grille (20) comprising modular uprights (10) of the type described. Moreover, said grille consists of the fixed frame (11) and at least one upper guide (12) or a lower guide (13)—although preferably both are present—between which the abovementioned modular uprights (10) may slide horizontally, said uprights (10) being fastened to these guides (12,13) so as not to slide vertically. The modular uprights (10) are then fastened together by connecting bars (14) arranged in pairs in an "X" shape so as to each interact with at least two, but preferably three, consecutive modular uprights (10). In the preferred solution, shown in the Figures, this is performed at their ends (14*a*, 14*b*) and in their central zone (14*c*). The connecting bars (14) are pivotably mounted on the modular uprights (10) in the region of the anti-pulling elements (6); therefore, said uprights will comprise alternately one or two anti-pulling elements (6) between two joining elements (2) depending on whether they are to be connected to the central zones (14*c*) or to the ends (14*a*,14*b*) of the connecting bars (14).

Two connecting bars (14) are in any case pivotably mounted on each anti-pulling element (6); the connecting bars of the same "X" in the central zone (14*c*) thereof or those of two consecutive "X"s at the ends (14*a*,14*b*). Only in this way is it possible to ensure that the grille (20) has a harmonic movement both during opening and during closing. In the modular uprights (10) where the central zones (14*c*) of the connecting bars (14) are hingeably mounted on the anti-pulling elements (6), it is preferable to use tubular spacers (7) inserted between the anti-cutting reinforcing elements (1) and the modular elements (3): the tubular spacers (7) in fact allow the anti-pulling element (6) to be kept fixed heightwise.

The invention thus conceived may be subject to numerous modifications and variations, all of which calling within the scope of the inventive idea.

Moreover, all the details may be replaced by technically equivalent elements.

In practice, modifications and/or improvements are obviously possible, all of which, however, fall within the scope of the following claims.

What is claimed is:

1. Modular upright for building structures, characterized in that the modular upright comprises at least one anti-cutting reinforcing element (1), a multiplicity of modular elements (3) which are shaped so as to line a portion of said reinforcing elements (1), a plurality of joining elements (2) provided with holes (4) through which the reinforcing elements (1) pass and means (5) for fastening to the modular elements (3) with which the modular units alternate in the vertical direction.

2. Modular upright according to claim 1, characterized in that the modular upright comprises end joining elements (2*a*,2*b*) provided with additional means (5*a*,5*b*) for fastening to a fixed frame (11).

3. Modular upright according to claim 2, characterized in that the additional fastening means comprise a wheel (5*a*) traveling in a rail (11*a*) of the fixed frame (11).

4. Modular upright according to claim 2, characterized in that the additional fastening means comprise a recess (5*b*) matching a shoulder (11*b*) projecting from the fixed frame (11).

5. Modular upright according to claim 1, characterized in that the modular upright comprises a pair of adjacent anti-cutting reinforcing elements (1), each lined by a multiplicity of U-shaped modular elements each having a cavity (3) arranged so that the respective cavities are facing and alternating with a plurality of joining elements (2), said reinforcing elements (1) being fastened together by at least one anti-pulling element (6) sliding vertically between two joining elements (2) in a space between the reinforcing elements (1) and the U-shaped modular elements (3) which cover them.

6. Modular upright according to claim 5, characterized in that the modular upright comprises tubular spacers (7) which are inserted between the anti-cutting reinforcing elements (1) and the modular elements (3) and are designed to keep the anti-pulling elements (6) fixed heightwise.

7. Modular upright according to claim 1, characterized in that the fastening means comprise lugs (5) shaped so as to match the internal profile of the modular elements (3).

8. Modular upright according to claim 5 characterized in that the anti-pulling elements (6) are in the form of a rod with a double ring so as to embrace the reinforcing elements (1) of an upright (10) passing through the facing cavities of the modular elements (3).

9. Sliding safety grille, comprising a fixed frame (11), at least one upper guide (12) or a lower guide (13), horizontally sliding uprights (10) fastened to at least one of said guides (11, 12), so as to avoid the vertical displacements thereof, and to each other by means of connecting bars (14) arranged in pairs in an "X" shape, characterized in that the sliding safety grille comprises modular uprights (10) according to any one of the preceding claims.

10. Sliding safety grille according to claim 9, characterized in that the connecting bars (14) are fastened to the uprights (10) in the region of anti-pulling elements (6).

11. Sliding safety grille according to claim 9, characterized in that each connecting bar (14) interacts with three consecutive modular uprights (10) at the connecting bar's ends (14*a*, 14*b*) and in the connecting bar's central zone (14*c*).

12. Sliding safety grille according to claim 10, characterized in that the sliding safety grille comprises modular uprights (10) provided with tubular spacers (7) which are designed to keep the anti-pulling elements (6) fixed heightwise.

* * * * *